US005998765A

United States Patent [19]

Mizuno et al.

[11] Patent Number: 5,998,765

[45] Date of Patent: Dec. 7, 1999

[54] CERAMIC GLOW PLUG

[75] Inventors: Takanori Mizuno; Katsuhiko Tanaka, both of Nagoya, Japan

[73] Assignee: NGK Spark Plug Co., Ltd., Nagoya, Japan

[21] Appl. No.: 08/972,544

[22] Filed: Nov. 18, 1997

[30] Foreign Application Priority Data

Nov. 19, 1996 [JP] Japan ..... 8-307762
Oct. 31, 1997 [JP] Japan ..... 9-300057

[51] Int. Cl.[6] ..... F23Q 7/22

[52] U.S. Cl. ..... 219/270; 219/541; 219/544; 219/553; 123/145 A

[58] Field of Search ..... 219/270, 544, 219/267, 552, 553, 541; 123/45 A; 361/264–266; 338/322

[56] References Cited

U.S. PATENT DOCUMENTS

| | | | |
|---|---|---|---|
| 4,475,029 | 10/1984 | Hoshida et al. | 219/270 |
| 4,650,963 | 3/1987 | Yokoi | 219/270 |
| 4,810,853 | 3/1989 | Maruta et al. | 219/270 |
| 4,912,305 | 3/1990 | Tatemasu et al. | 219/544 |
| 4,929,813 | 5/1990 | Masaka et al. | 219/270 |
| 5,059,768 | 10/1991 | Hatanaka et al. | 219/270 |
| 5,218,183 | 6/1993 | Kimata | 219/270 |
| 5,362,944 | 11/1994 | Hatanaka et al. | 219/270 |
| 5,750,958 | 5/1998 | Okuda et al. | 219/267 |

FOREIGN PATENT DOCUMENTS

| | | |
|---|---|---|
| 0 763 693 A1 | 3/1997 | European Pat. Off. . |
| 44 33 505 | 3/1995 | Germany . |
| 58-106325 | 6/1983 | Japan . |

*Primary Examiner*—Philip H. Leung
*Assistant Examiner*—Vinod D. Patel
*Attorney, Agent, or Firm*—Morgan, Lewis & Bockius LLP

[57] ABSTRACT

A ceramic glow plug (A) is constituted by a metallic sheath (1); a cylindrical main metallic shell (2) having a holding part (21) which holds a rear part (11); an ceramic heating element (3) fitted into the metallic sheath (1) and obtained by connecting one-side ends (331, 341) of lead-out wires (33, 34) respectively to the ends (321, 322) of a heating resistor (32) to obtain a heater main body, embedding the heater main body in a ceramic powder, and hot-pressing and sintering the powder; a terminal electrode (4) inserted into the cylindrical main metallic shell (2) on its rear end side and insulated therefrom; and lead coils (51, 52) connected to the lead-out wires (33, 34) in such a manner that one-side ends of the coils (51, 52) are brazed respectively to those areas of the lead-out wires (33, 34) which are exposed on the bake surface with a high-purity silver-based brazing material and the other ends thereof are electrically connected respectively to the cylindrical main metallic shell (2) and the terminal electrode (4).

8 Claims, 3 Drawing Sheets

CERAMIC GLOW PLUG

BACKGROUND OF THE INVENTION

1. Field of the Invention

The present invention relates to a ceramic glow plug to be fitted to a diesel engine.

2. Description of the Related Art

A ceramic glow plug generally comprises: a metallic sheath; a cylindrical main metallic shell having at the front end thereof a holding part which extends inward and holds a rear part of the metallic sheath; a ceramic heater, a terminal electrode inserted into the cylindrical main metallic shell on its rear end side and insulated therefrom; and a pair of external connecting wires connected to the lead-out wires in such a manner that one side ends of the external connecting wires are brazed respectively to the exposed areas of the lead-out wires and the other ends thereof are electrically connected respectively to the main metallic shell and the terminal electrode.

This ceramic glow plug is produced through the following steps (1) to (4).

(1) A heater main body comprising a heating material and a pair of lead-out wires having one-side ends connected respectively to the ends of the heating material is embedded in a powder of a ceramic, e.g., $Si_3N_4$, and this powder containing the heater main body embedded therein is sintered by hot pressing to produce a ceramic heater.

(2) One-side ends of two external connecting wires are brazed respectively to exposed areas of the lead-out wires, before the ceramic heater is inserted into and fixed to a metallic sheath.

(3) This assembly is inserted into a cylindrical main metallic shell, and a rear part of the metallic sheath is brazed to the inner wall of a holding part of the main metallic shell.

(4) A terminal electrode is fixed to the main metallic shell with an insulator and a nut.

However, the ceramic glow plug produced through the steps described above has the following problems.

During brazing, those areas of the lead-out wires which are exposed on the bake surface may suffer oxidative corrosion due to the brazing temperature of 800 to 1,100° C.

In this case, the lead-out wires corrode at an increased rate during use of the ceramic glow plug. Further, in such a ceramic glow plug, irregularity in initial resistance is increased and change in resistance during ordinary use is also increased.

SUMMARY OF THE INVENTION

It is an object of the present invention to provide a glow plug in which lead-out wires are electrically connected to exposed areas of external connecting wires while preventing oxidative corrosion, and which undergoes little change in resistance during use and has excellent durability.

A ceramic glow plug according to the present invention is comprised of: a ceramic heater having a heater body including first and second lead-out wires comprising tungsten each having first and second end portions and a heat-resistant body having both ends which are respectively connected to the first end portions of the first and second lead-out wires, and a ceramic base material containing the heater body embedded therein, the second end portions of the first and the second lead-out wires exposing to a surface of the ceramic base material; and first and second external connecting wires each having first and second end portions, the first end portions of the first and second external connecting wires being brazed by a high-purity silver-based brazing material to the second end portions of the first and second lead-out wire, respectively, the second end portions of the first and second external connecting wires being electrically connected to a main metallic shell and a terminal electrode.

A high-purity silver-based brazing material is used for brazing the exposing surface of the lead-out wires to the ends of the external connecting wires.

Accordingly, the lead-out wires during brazing can be prevented from being oxidatively corroded by brazing material components (e.g., copper) other than silver, whereby brazing failure caused by the corrosion can be avoided. As a result, the electrical connection between the lead-out wires and the external connecting wires can be established without fail.

Consequently, the ceramic glow plug undergoes little irregularity in initial resistance and little change in resistance due to the hot/cold repetition such as using condition of an engine and has excellent durability.

DETAILED DESCRIPTION OF THE INVENTION

Detailed description of the present invention will be described as follows referring to the accompanying drawings.

Figure 1:
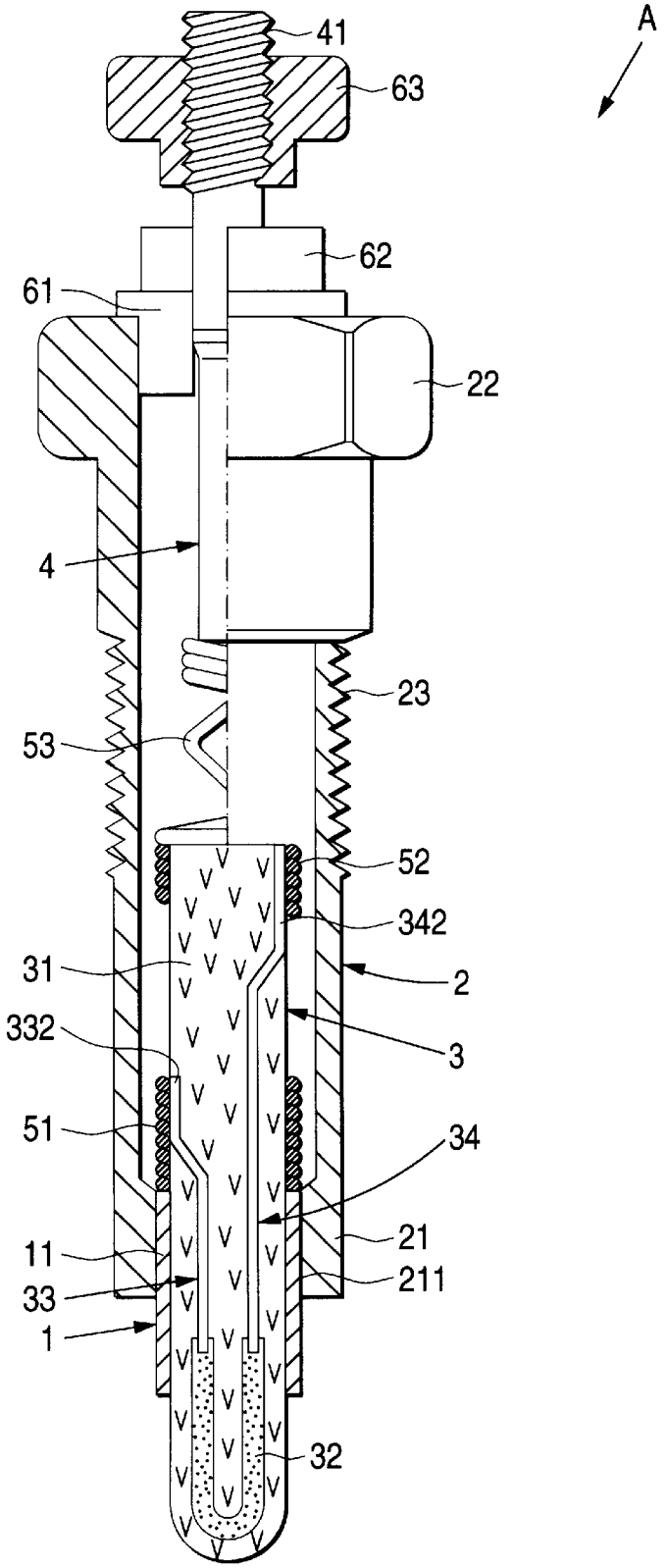
FIG. 1 is a sectional view of a glow plug as the first embodiment of the present invention.
Figure 2:
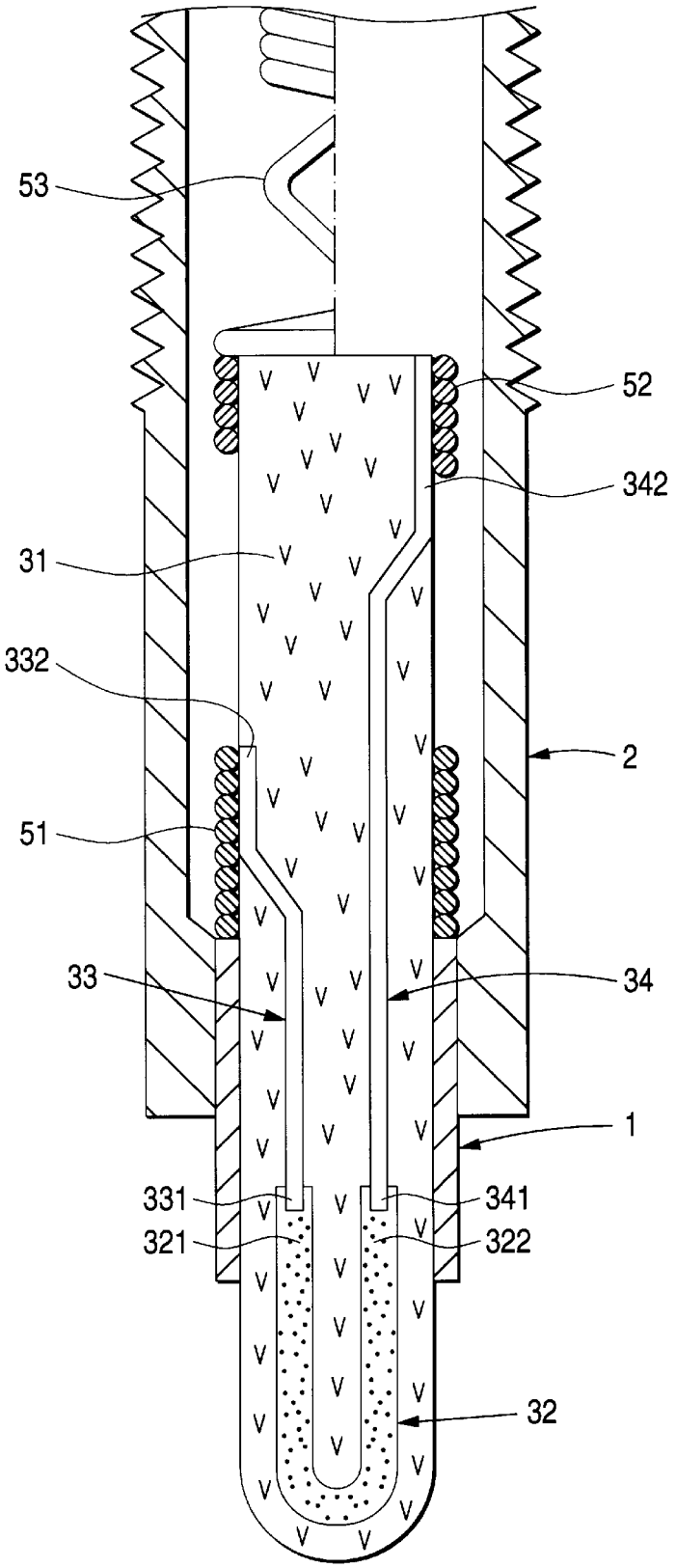
FIG. 2 is an enlarged sectional view illustrating important parts of the glow plug.

As shown in FIG. 1, a glow plug A has: a metallic sheath 1; a cylindrical main metallic shell 2 having at the front end thereof a holding part 21 for holding a rear part 11 of the metallic sheath 1; an ceramic heating element 3 fitted into the metallic sheath 1; and a terminal electrode 4 inserted into the cylindrical main metallic shell 2 and insulated therefrom.

The metallic sheath 1 having a wall thickness of 0.6 mm is made of a heat-resistant metal, and the rear part 11 is brazed to the inner wall 211 of the holding part 21 with silver-based brazing material.

The cylindrical main metallic shell 2 made of carbon steel having at the front end thereof the holding part 21 extending inward further has at the rear end thereof a hexagonal part 22 for wrenching and in an intermediate part thereof a screw thread 23 for screwing the glow plug to a combustion chamber of a diesel engine (not shown).

The ceramic heating element 3, which is produced by the process described later, has a ceramic base material, and lead-out wires 33, 34 and a U-shaped heating resistor 32 embedded in the ceramic base material. Incidentally, the heating resistor 32 is embedded into the ceramic base material 31 so that the distance between the surface of the heating resistor 32 and that of the ceramic base material 31 is 0.3 mm or more. Accordingly, the heating resistor 32 can not only be prevented from oxidizing even when heated to high temperatures (800–1,500° C.), but also retain high mechanical strength.

The lead-out wires 33, 34 each consists of a tungsten wire having a diameter of 0.3 mm. One-side ends 331, 341 thereof are connected respectively to the ends 321, 322 of the heating resistor 32, while the other ends 332, 342 thereof are exposed on the ceramic surface in an intermediate part and a rear part, respectively, of the ceramic base material 31.

The other end 332 of the lead-out wire 33 is electrically connected to a lead coil 51 of a pure-nickel wire as an external connecting wire and connected to the cylindrical main metallic shell 2 through the metallic sheath 1.

The other end 342 of the lead-out wire 34 is electrically connected to a lead coil 52, 53 of a heat-resist nickel alloy wire as an external connecting wire, and further electrically connected to the terminal electrode 4.

The terminal electrode 4, which has a screw thread 41, is fixed to the cylindrical main metallic shell 2 with an insulator 61 and a nut 62 so that the electrode 4 is insulated from the metallic shell 2. Numeral 63 denotes a nut for fixing an electrical supply fitting (not shown) to the terminal electrode 4.

Incidentally, in the case of a glow plug which is used for kinds of engine such as a gas turbine in which the tip end of the cylindrical main metallic shell 2 attaches to the engine, all of the lead coils (external connecting wires) 51, 52, 53 are preferably pure nickel wires. Further, in this case, the silver-based brazing material used for brazing the lead coils is preferably a silver-based brazing material having the silver content higher than that of the silver-based brazing material for electrically connecting the other-side ends 332, 342 of the lead-out wires 33, 34.

A processes for producing the ceramic heating element 3 is explained next.

A tungsten wire is cut into given lengths and formed into given shapes.

The raw material of the heating resistor is composed of 58.4 wt % of WC and 41.6 wt % of an insulating ceramic including 89 parts by weight of $Si_3N_4$, 8 parts by weight of $Er_2O_3$, 1 part by weight of $V_2O_3$ and 2 parts by weight of $WO_3$.

A dispersion agent and a solvent are added to the raw material, and after crushing and during the mixture, an organic binder is added to produce a granular material.

Figure 3:
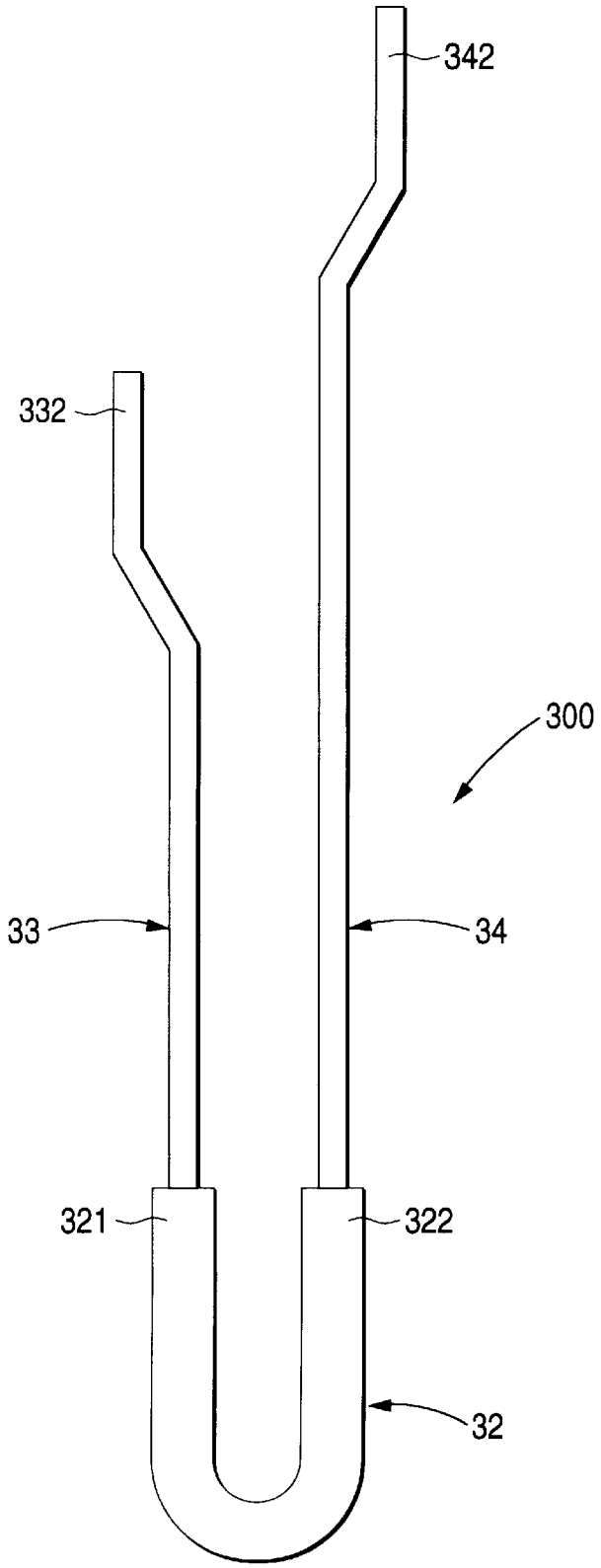
FIG. 3 is a view illustrating a heater main body completed.

The granular material thus obtained is injection-molded so as to be connected to one-side ends 331, 341 of the lead-out wires 33, 34 (and uncoated lead-out wires). Thus, an integrated unsintered heater body 300 is completed with forming a U-shaped unsintered heat resistor 32. (see, FIG. 3)

Next, a ceramic powder is prepared.

The raw material of the ceramic powder is composed of 3.5 wt % of $MoSi_2$ and 96.5 wt % of an insulating ceramic including 89 parts by weight of $Si_3N_4$, 8 parts by weight of $Er_2O_3$, 1 part by weight of $V_2O_3$ and 2 parts by weight of $WO_3$.

Among these components, at first, a dispersion agent and water are added to $MoSi_2$, $Er_2O_3$, $V_2O_3$ and $WO_3$. After crushing the mixture, $Si_3N_4$ is added and then, the mixture is crushed again. Thereafter, an organic binder is added to the again crushed mixture to produce a granular material.

This ceramic powder is used to form a half-divided press body.

The heater main body 300 is placed on the half-divided press body. The ceramic powder is filled thereon, and then a press-molded body.

The press-molded body thus obtained is set in a carbon mold and hot-pressed at 1,750° C. in an $N_2$ gas atmosphere while applying a pressure of 200 kg/cm$^2$. Thus, a hot-press sintered body in the form of a nearly round rod with a semispherical front end is obtained.

The outer surface of this ceramic sintered body is ground to finish so as to have a given cylindrical dimension and, at the same time, to expose the other ends 332, 342 of the lead-out wires 33, 34 on the surface of the ceramic base material 31. Thus, a ceramic heating element 3 is completed.

A glass layer is formed through baking on the ceramic heating element 3 in its area where the element 3 is held by a metallic sheath 1 and in its peripheral areas where the element 3 is connected to lead coils (external connecting wires) 51, 52 excluding the exposed areas of the lead-out wires 33, 34.

Subsequently, the ceramic heating element 3 is fitted into a metallic sheath 1.

The lead coils (external connecting wires) 51, 52 described later are brazed to the exposed areas of the other ends 332, 342 of the lead-out wires 33, 34 with the high-purity silver-based brazing materials described later (Ag 80 wt %-Cu 20 wt %, Ag 85 wt %-Cu 15 wt %) silver brazing materials and pure silver brazing material).

This assembly containing the ceramic heating element 3 is inserted into a cylindrical main metallic shell 2. A rear part 11 of the metallic sheath 1 is brazed with silver-based brazing material to the inner wall 211 of a holding part 21 of the main metallic shell 2.

Furthermore, a terminal electrode 4 is fixed to the main metallic shell 2 with an insulator 61 and a nut 62. Thus, a glow plug A is completed.

A flowability test for brazing materials is explained next (see Table 1).

The flowability of each of pure silver, Ag 85 wt %-Cu 15 wt %, Ag 80 wt %-Cu 20 wt %, Ag 72 wt %-Cu 28 wt % (BAg-8), and Ag 50 wt %-Cu 50 wt % brazing materials was examined at brazing temperatures of 980° C. and 1,100° C. using pure-tungsten wires as the lead-out wires 33, 34 and using heat-resistant Ni alloy wires (1.5 wt % of Si, 2.0 of wt % Mn, 1.5 wt % of Cr, and the balance of Ni), a heat-resistant Ni alloy wires plated with nickel (3 $\mu$m), or pure-nickel wires as the lead coils (external connecting wires) 51, 52.

In the case of using a pure silver brazing material in combination with the heat-resistant Ni alloy wires as the lead coils (external connecting wires) 51, 52, the brazing material shows poor flowability because the heat-resistant Ni-alloy wires have on the surfaces thereof a component which repels the pure silver brazing material. It is therefore necessary to use the Ni-plated heat-resistant Ni-alloy wires or pure-nickel wires as the lead coils 51, 52 when the pure silver brazing material is used. The brazing material having the best flowability (the brazing material wholly flowed) is indicated by "◎", those having good flowability (the brazing material almost flowed) are indicated by "○", and those having poor flowability (the brazing material did not flow) are indicated by "x".

In accordance with the result as shown in Table 1, the Ni-plated (3 $\mu$m) heat-resistant Ni-alloy wire, or the pure-nickel wire is desirably used as the lead coils (external connecting wires) 51, 52.

Incidentally, in the heat-resistant Ni-alloy wires, the flowability of the pure silver is not good, because it is considered that Cr contained in the heat-resistant Ni-alloy wire has a property to repel silver.

The flowability of the Ni-plated heat-resistant Ni-alloy wire is not good in comparison with the pure-nickel wire, because it may occur plating nonuniformity and/or plating peeling due to heat.

TABLE 1

Lead coil wire materials and brazing material flowability
[◎: best, ○: good, x: poor]

| Brazing temperature / Brazing material | Lead coil wire material: Ni-alloy wire | Ni-plated Ni-alloy wire | Pure-Ni wire |
|---|---|---|---|
| 980° C. | | | |
| Ag50-Cu50 | ○ | ○ | ◎ |
| Ag72-Cu28 | ○ | ○ | ◎ |
| Ag80-Cu20 | ○ | ○ | ◎ |
| Ag85-Cu15 | ○ | ○ | ◎ |
| Pure silver | x | ○ | ◎ |
| 1,100° C. | | | |
| Ag50-Cu50 | ○ | ○ | ◎ |
| Ag72-Cu28 | ○ | ○ | ◎ |
| Ag80-Cu20 | ○ | ○ | ◎ |
| Ag85-Cu15 | ○ | ○ | ◎ |
| Pure silver | x | ○ | ◎ |

(Lead-out wires: pure-tungsten wires)

Next, a test for oxidative corrosion by current application is then explained (see Table 2).

Pure-nickel wires were used as the lead coils (external connecting wires) 51, 52. For brazing the lead coils to pure-tungsten lead-out wires 33, 34 {(−) side and (+) side}, use was made of a pure silver, Ag 85 wt %-Cu 15 wt %, Ag 80 wt %-Cu 20 wt %, Ag 72 wt %-Cu 28 wt % (BAg-8), or Ag 50 wt %-Cu 15 wt % brazing material. Five samples for each brazing material were examined for resistance to oxidative corrosion by current application and for resistance change.

The samples were subjected to ten cycles each consisting of 60-second application of 6 V and quenching in water.

Through the ten cycles, samples which changed its resistance of +1.5 wt % to 1.0 wt % based on the resistance value before the test (designed value: 700 mΩ) are indicated by "○", those which changed its resistance of +1.0 wt % or less are indicated by "◎", and those which exceeded its resistance of larger than +1.5 wt % before the ten cycles are indicated by "x".

After the test, when the lead coil (external connecting wires) (51, 52) was peeled from the ceramic heating element 3, the brazing material and a part of the lead-out wire (33, 34) were peeled therefrom with the lead coil (51, 52). The oxidative corrosion by current application was evaluated based on the luster of the lead-out wire. That is, the peeled lead-out wire having matallic luster is indicated by "◎", that was somber without luster is indicated by "○", and that was changed to black is indicated by "x".

The data given in Table 2 show that the brazing materials suitable for use in obtaining both excellent resistance to oxidation and corrosion by current application and a small resistance change are the pure silver and 80 wt % silver brazing materials.

TABLE 2

Influence of brazing materials for tungsten leads on resistance to oxidative corrosion by current application
[◎: best, ○: good, x: poor]

| Brazing material | oxidative corrosion by current application of W-lead | resistance change |
|---|---|---|
| Ag50-Cu50 | x | x |
| Ag72-Cu28 | x | x |
| Ag80-Cu20 | ○ | ○ |
| Ag85-Cu15 | ○ | ○ |
| pure silver | ◎ | ◎ |

(Lead coil material: pure nickel)

Results of a comprehensive brazing test are then explained (see Table 3).

The compatibility of each of the heat-resistant Ni-alloy wire, the nickel-plated (3 μm) heat-resistant Ni-alloy wires, and pure-nickel wires as the lead coils (external connecting wires) 51, 52 with each of pure silver, Ag 85 wt %-Cu 15 wt %, Ag 80 wt %-Cu 20 wt %, Ag 72 wt %-Cu 28 wt % (BAg-8), and Ag 50 wt %-Cu 50 wt % brazing materials was evaluated using pure-tungsten wires as the lead-out wires 33, 34. The brazing temperature used was 980° C., and the brazing was conducted in an $N_2$ gas atmosphere.

In evaluating brazing material flowability, each sample was checked on the side of the lead-out wires 33, 34 and on the side of the lead coils 51, 52. The brazing materials showing the best flowability (the brazing material wholly flows) are indicated by "◎", those showing good flowability (the brazing material almost flows) are indicated by "○", and that showing poor flowability (the brazing material does not flow) is indicated by "x".

With respect to the test of pure-tungsten lead-out wires 33, 34 for oxidative corrosion by current application, evaluation was made as follows. Through the ten cycles each consisting of 60-second application of 6 V and quenching in water, samples which changed its resistance of +1.5 wt % to 1.0 wt % based on the resistance value before the test (designed value: 700 mΩ) are indicated by "○", those which changed its resistance of +1.0 wt % or less are indicated by "◎", and those which exceeded its resistance of larger than +1.5 wt % before the ten cycles are indicated by "x".

For the comprehensive judgement, the following criteria were used. The samples which gained two or more "◎"s are rated as "best (◎)", while those which gained two or more "○"s are rated as "good (○)". The samples which had at least one "x" are rated as "poor (x)".

Incidentally, when the lead coil material is the Ni-alloy wire and the brazing material is the pure silver, the flowability is poor (x). However, the resistance change is small and the oxidative corrosion does not proceed. Accordingly, although this case has one (x:bad), the comprehensive judgement is made as "Δ".

TABLE 3

Results of brazing of different lead coil materials with different brazing materials

| Lead coil material | Brazing material | Flowability of brazing material: W-lead | Flowability of brazing material: Lead coil | Resistance change by current-applying oxidative corrosion test | judge | note |
|---|---|---|---|---|---|---|
| Ni-alloy wire | Ag50-Cu50 | ○ | ○ | x | x | *1 |
| | Ag72-Cu28 | ○ | ○ | x | x | *1 |
| | Ag80-Cu20 | ○ | ○ | ○ | ○ | |
| | Ag85-Ag15 | ○ | ○ | ○ | ○ | |
| | Pure | ◎ | x | ○ | Δ | *2 |
| Ni-plated Ni-alloy wire | Ag50-Cu50 | ○ | ○ | x | x | *1 |
| | Ag72-Cu28 | ○ | ○ | x | x | *1 |
| | Ag80-Cu20 | ○ | ○ | ○ | ○ | |
| | Ag85-Ag15 | ○ | ○ | ○ | ○ | |
| | Pure | ◎ | ○ | ◎ | ◎ | |
| pure Ni wire | Ag50-Cu50 | ○ | ◎ | x | x | *1 |
| | Ag72-Cu28 | ○ | ◎ | x | x | *1 |
| | Ag80-Cu20 | ○ | ◎ | ○ | ○ | |
| | Ag85-Ag15 | ○ | ◎ | ○ | ○ | |
| | Pure | ◎ | ◎ | ◎ | ◎ | |

*1: W-lead was oxidative-corroded by current application.
*2: Poor flowability of brazing material Besides the embodiment described above, the present invention includes the following embodiments.

a. The heating resistor may be a metallic heating coil (e.g., a W-Re wire or a tungsten wire), besides nonmetallic heating elements such as that used in the above embodiment (a mixture of WC and $Si_3N_4$).

b. The lead-out wires may be wires of a tungsten alloy, e.g., a W-Si alloy or a W-Ni alloy, besides the lead-out wires used in the above embodiment (wires of pure tungsten).

c. The ceramic may be Sialon, AlN, or the like, besides $Si_3N_4$.

d. The nickel-coated wires used above were nickel alloy wires plated with nickel. However, iron or iron alloy wires coated with nickel may also be used.

What is claimed is:

1. A ceramic glow plug comprising:

a ceramic heater having a heater body including first and second lead-out wires comprising tungsten each having first and second end portions and a heat-resistant body having both ends which are respectively connected to said first end portions of said first and second lead-out wires, and a ceramic base material containing said heater body embedded therein, said second end portions of said first and said second lead-out wires being exposed to a surface of said ceramic base material; and first and second external connecting wires each having first and second end portions, said first end portions of said first and second external connecting wires being brazed by a high-purity silver-based brazing material to said second end portions of said first and second lead-out wire, respectively, for electrical connection, and said second end portions of said first and second external connecting wires being electrically connected to a main metallic shell and a terminal electrode.

2. A ceramic glow plug according to claim 1, further comprising:

a metallic sheath;

a cylindrical main metallic shell having at the front end thereof a holding part which extends inward and holds a rear part of said metallic sheath; and a terminal electrode inserted into said cylindrical main metallic shell on a rear end side thereof and insulated therefrom;

wherein said ceramic heater is fitted into said metallic sheath, and said second end portions of said first and second external connecting wires are electrically connected to said cylindrical main metallic shell and said terminal electrode, respectively.

3. A ceramic glow plug according to claim 2, wherein:

said second end portion of said first lead-out wire exposes to a rear part of said ceramic base material, and said second end portion of said second lead-out wire exposes to a intermediate part of said ceramic base material; and said ceramic heater is fitted into said metallic sheath so that the exposing surfaces of said second end portions of said first and second lead-out wires are covered with said metallic sheath.

4. A ceramic glow plug according to claim 3, wherein:

said first end portion of said first external connecting wire is brazed with a first high-purity silver-based brazing material to the exposing surface of said second end portion of said first lead-out wire, and said second end portion of said first external connecting wire is electrically connected to said terminal electrode; and said second end portion of said second external connecting wire is brazed with a second high-purity silver-based brazing material to said main metallic shell.

5. A ceramic glow plug according to claim 4, wherein the silver content of said second high-purity silver-based brazing material is higher than that of said first high-purity silver-based brazing material.

6. A ceramic glow plug according to claim 4, wherein said second external connecting wire is a pure nickel wire.

7. A ceramic glow plug according to claim 1, wherein said high-purity silver-based brazing material contains 80 wt % or more of silver.

8. A ceramic glow plug according to claim 1, wherein said first and second external connecting wire are at least one of a pure nickel wire, a nickel alloy wire and a nickel coated wire.

* * * * *